United States Patent [19]

Shoji et al.

[11] 4,309,690

[45] Jan. 5, 1982

[54] MINIATURE VARIABLE RESISTOR

[75] Inventors: Yutaka Shoji; Yoshio Suzuki; Shigekata Sugiura; Akihiko Inoue, all of Soma, Japan

[73] Assignee: Alps Electric Co., Ltd., Tokyo, Japan

[21] Appl. No.: 132,537

[22] Filed: Mar. 21, 1980

[30] Foreign Application Priority Data

Mar. 27, 1979 [JP] Japan ..... 54-39432[U]

[51] Int. Cl.[3] ..... H01C 10/32

[52] U.S. Cl. ..... 338/163; 338/184; 338/199

[58] Field of Search ..... 338/163, 162, 160, 164, 338/174, 184, 199

[56] References Cited

U.S. PATENT DOCUMENTS 3,032,734 5/1962 Zunker et al. ..... 338/163
3,377,605 4/1968 Baskett ..... 338/162
3,380,011 4/1968 Baskett ..... 338/162

FOREIGN PATENT DOCUMENTS 796931 6/1958 United Kingdom ..... 338/163

*Primary Examiner*—C. L. Albritton
*Attorney, Agent, or Firm*—Guy W. Shoup; Gerard F. Dunne

[57] ABSTRACT

A miniature variable resistor comprising an insulating substrate provided with a hole therethrough. A resistance pattern which is carried on a front surface of the insulating substrate in a manner to surround the hole, and a hollow rotor of insulating synthetic resin is provided with an operating portion and a slidable contact portion slidable on the front surface. A slide member is unitarily embedded in the rotor and which has elastic protuberant pieces protruding into the hollow portion of the rotor, and a shaft member which protrudes beyond the hole from a rear surface of the insulating substrate is fitted tightly in the hollow portion of the rotor.

8 Claims, 8 Drawing Figures

MINIATURE VARIABLE RESISTOR

BACKGROUND OF THE INVENTION

The present invention relates to a miniature variable resistor. More particularly, it relates to a variable resistor which may be used suitably as a trimmer variable resistor for setting a preset voltage in an electronic tuner or the like.

As disclosed in, for example, U.S. Pat. No. 3,032,734, a variable resistor of this type has a slide member mounted on an insulating substrate carrying a resistance element extending around a hole extending through a central portion of the substrate. The slide member can be arranged to be in sliding contact with the resistance element and is adapted to be held on the substrate by inserting the shaft of a knob member formed of synthetic resin through the hole in one simple motion.

In the structure as described above, however, the slide member and the knob member are separate individual components before assemblage. Moreover, trimmer potentiometers of the specified type are, in general, very small in size. Accordingly, there has been the disadvantage that the assembling operations become unduly complicated.

SUMMARY OF THE INVENTION

It is therefore an object of the present invention to provide a miniature variable resistor which is simple in structure and easy to assemble.

Another object of the present invention is to provide a miniature variable resistor which can be assembled automatically.

Still another object of the present invention is to provide a miniature variable resistor which has a small number of components, and which is inexpensive.

In order to accomplish the objects, according to the present invention, a slide member is unitarily embedded in a hollow rotor made of synthetic resin and is thus fixed to the rotor, and elastic protuberant pieces for fixation are disposed in the hollow portion of the rotor in a manner to extend from the slide member.

Further objects and advantages of the present invention will become apparent from the following description taken with reference to the drawings.

DESCRIPTION OF THE PREFERRED EMBODIMENTS

Figure 1:
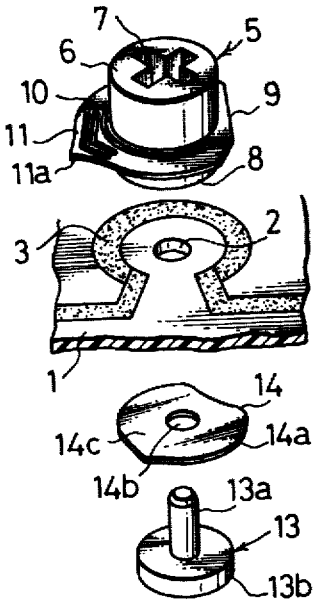
FIG. 1 is an exploded perspective view of an embodiment of the present invention.
Figure 2:
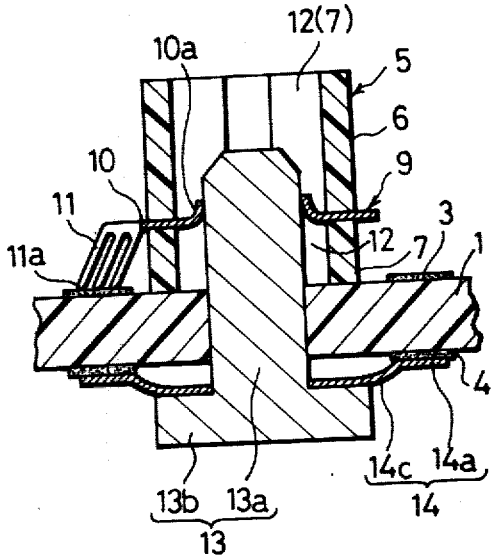
FIG. 2 is a sectional view of the embodiment of the present invention.

Hereunder, the details of the present invention will be described along an embodiment shown in FIGS. 1 to 4.

In the figures, numeral 1 designates an insulating substrate such as a laminated phenolics plate. Numeral 2 designates a hole provided through the insulating substrate 1, and although only one hole is illustrated in the drawing, such holes are provided at equal intervals in large numbers in the insulating substrate 1. Around each hole 2, a resistance pattern 3 and a conductor pattern 4 are respectively formed on the front and rear surfaces of the substrate 1 in a manner to encircle the hole 2 (refer to FIG. 2).

Shown at 5 is a hollow cylindrical rotor which is made of an insulating synthetic resin. It includes an operating portion 6 which is provided with a driver groove 7 formed in a generally cross shape, and a sliding contact portion 8 which slides on the insulating substrate 1 in contact therewith. A slide member 9 to be described below is unitarily embedded in the rotor 5 by insert-molding techniques.

Figure 3:
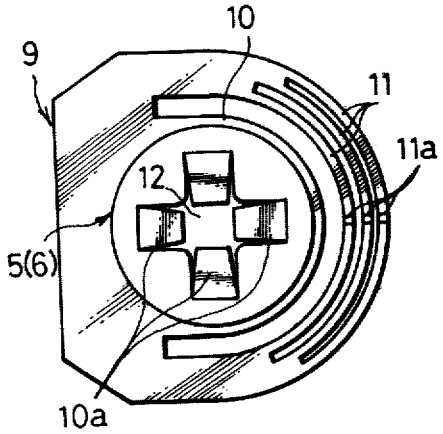
FIG. 3 is a plan view of a rotor to which a slide member is fixed in the present invention.
Figure 4:
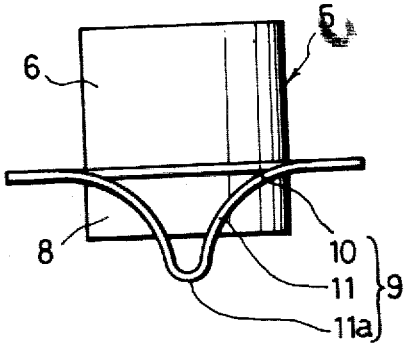
FIG. 4 is a front view of the rotor shown in FIG. 3.

Referring to FIG. 3, the slide member 9 is made of a metallic sheet of high electric conductivity and includes an inner arm 10 and an outer arm 11. The outer arm 11 is divided into three slender strips, the middle parts of which are bent downwardly to form a contact portion **11*a* as clearly seen from FIG. 4. The inner arm 10 is partially embedded in the rotor 5 and has its elastic protuberant pieces 10*a* protruding into the hollow portion 12 of the rotor 5. The elastic protuberant pieces 10*a* are brought into firm fit engagement with a shaft member 13 to be described later, and function to ensure electrical contact between the slide member 9 and the shaft member 13** and a tight engagement between them.

Numeral 14 indicates a spring washer which is made of a metallic sheet of high electric conductivity. It includes a contact portion **14*a* which slides in contact with the conductor pattern 4 disposed on the rear surface of the insulating substrate 1, and a depressed portion 14*c* which is provided with an aperture 14*b* for inserting the shaft member 13** therethrough.

The shaft member 13 is made of a metal material of high electric conductivity, and includes a shaft portion **13*a* and a disc portion 13*b*. As clearly seen from FIG. 2, under the state under which the shaft portion 13*a* penetrates through the spring washer 14, the shaft member 13 is inserted into the hole 2 from the rear side of the insulating substrate 1 and is brought into firm fit engagement in the hollow portion 12 of the rotor 5. Thus, the shaft portion 13*a* of the shaft member 13 is reliably contacted with and held by the contact member 9 owing to the elastic forces of the elastic protuberant pieces 10*a* stated previously. Preferably, the elastic pieces have their end portions bent upwards to further prevent the shaft portion 13*a* from sliding out of contact therewith. Under this assembled state, the contact member 9 and the spring washer 14 are respectively held in contact with the resistance pattern 3 and the conductor pattern 4 under appropriate elastic pressures, and the resistance pattern 3 and the conductor pattern 4 are electrically connected through the contact member 9, the shaft member 13 and the spring washer 14. Accordingly, by driving the operating portion 6 of the rotor 5 by means of a screw driver or the like, the slide member 9 slides on the resistance pattern 3 along with the rotor 5**, and a desired resistance value can be attained.

As apparent from the above description, according to the present invention, the variable resistor is assembled in such a way that the rotor member 5 and the shaft member 13 are rotatably mounted on the insulating substrate 1 by bringing the elastic protuberant pieces 10*a* protruding into the hollow portion 12 of the rotor member 5 into tight engagement with the shaft member 13. Owing to the elastic forces of the elastic protuberant pieces 10*a*, therefore, the mechanical coupling between the shaft member 13 and the rotor member 5 is extraordinarily reliable and rigid, and the electrical contact between them is stable. In addition, since the shaft member 13 and the rotor 5 may be merely press fitted into engagement, the assembling efficiency is excellent, and the automation of the assemblage is easy in view of the small number of components and the simple structures thereof. Especially where a large number of variable resistors are to be assembled on a single substrate, there is the practically remarkable effect that a sharp enhancement in the job efficiency can be achieved by such automatic assemblage.

Further, the resistance patterns 3 and the conductor patterns 4 (collector patterns) can be easily separated on the front and rear surfaces of the insulating substrate 1 with the spring washers 14 serving also as the electrical connection to the conductor patterns 4. The shaft members 13 are inserted into the rotors 5 from the rear side of the substrate 1 so as to be coupled with the rotors 5, and it is thus possible to raise the packing density of the patterns on the insulating substrate 1 and miniaturize the variable resistors, and besides, the contact pressures of the slide members 9 and the spring washers 14 are more stabilized owing to the presence of the spring washers 14.

Figure 5:
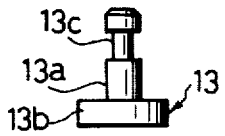
FIG. 5 is a front view of a shaft member according to another embodiment of the present invention.
Figure 6:
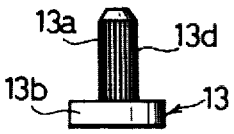
FIG. 6 is a front view of a shaft member according to still another embodiment of the present invention.
Figure 7:
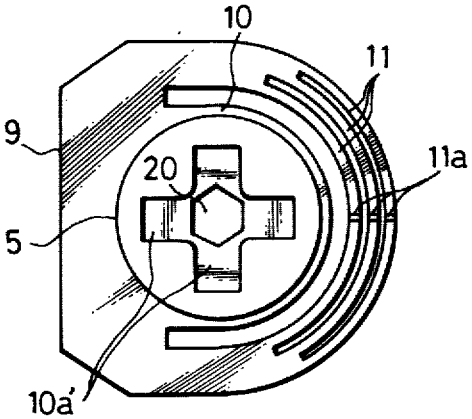
FIG. 7 is a plan view of a rotor to which a slide member according to another embodiment of the present invention is fixed.
Figure 8:
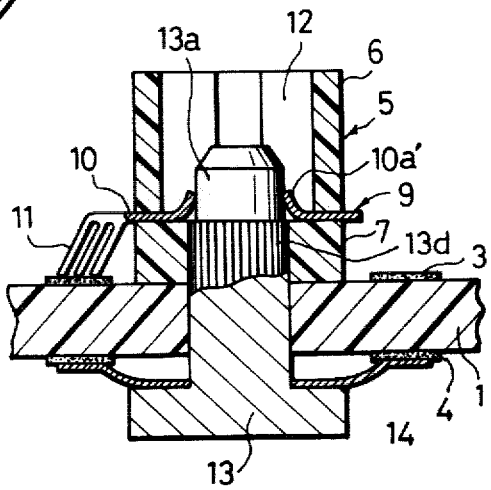
FIG. 8 is a sectional view of another embodiment of the present invention.

In the foregoing embodiment, the shaft portion 13*a* of the shaft member 13 is in the shape of a circular cylinder. In some cases, however, a step portion 13*c* may be provided as shown in FIG. 5, or a serration portion 13*d* may be provided as shown in FIG. 6, whereby the contact and coupling between the shaft member 13 and the contact member 9 are ensured still more. Also in some cases, the elastic protuberant pieces 10*a* are not made separate, but as illustrated in FIGS. 7 and 8, integral elastic protuberant pieces 10*a* may be provided with a hexagonal aperture 20 and the shaft portion 13*a* of the shaft member 13 may then be pressed into the aperture 20; or the serration portion 13*d* of the shaft member 13 may be pressed into the rotor 5. Various modifications may be made without departing from the scope and spirit of the present invention, and it is a matter of course that all such modifications fall within the scope of the present invention.

What is claimed is:

1. A miniature variable resistor comprising:

an insulating substrate formed with a hole;

a resistance element carried on a front surface of said insulating substrate and extending around said hole;

a rotor member formed of synthetic resin and including an operating portion, a sliding contact portion adapted to slide on said front surface of said insulating substrate in contact herewith, and a hollow portion extending in the axial direction of said rotor member;

a slide member fixed to said rotor member and including a slider slidable on said resistance element and an elastic portion protruding into said hollow portion of said rotor member; and means for holding said rotor member in place on said insultating substrate, said holding means including a shaft member penetrating said hole of said insulating substrate to protrude into said hollow portion of said rotor member from a rear surface of said insulating substrate and engage said elastic portion of said slide member to be held securely thereby.

2. A miniature variable resistor according to claim 1, said slide member being insert-molded in said rotor member.

3. A miniature variable resistor according to claim 1, wherein said elastic portion of said slide member consists of a plurality of elastic protuberant pieces which protrude in a direction intersecting with the path of said shaft member in said hollow portion of said rotor member.

4. A miniature variable resistor according to claim 3, wherein respective fore ends of said plurality of elastic protuberant pieces are bent upwards so as to prevent said shaft member from being removed.

5. A miniature variable resistor according to claim 1, wherein said operating portion of said rotor member being formed with a groove for receiving a screwdriver.

6. A miniature variable resistor according to claim 1, wherein said shaft member has a disc portion at a lower end thereof, and a spring washer is interposed between said disc portion and said insulating substrate.

7. A miniature variable resistor comprising:

an insulating substrate formed with a hole therethrough;

a resistance element carried on a front surface of said insulating substrate and extending around said hole;

a conductor element carried on a rear surface of said insulating substrate in proximately to said hole;

a rotor member formed of synthetic resin and including an operation portion, a sliding contact portion adapted to slide on said front surface of said insulating substrate in contact herewith, and a hollow portion extending in the axial direction of said rotor member;

a slide member fixed to said rotor member and including a slider slidable on said resistance element and an elastic portion protruding into said hollow portion of said rotor member;

a conductive shaft member extending through said hole of said insulating substrate and protruding into said hollow portion of said rotor member from said rear surface of said insulating substrate to engage said elastic portion of said slide member in said hollow portion; and means for electrically connecting said slide member and said conductor element on said rear surface of said insulating substrate.

8. A miniature variable resistor according to claim 7, wherein the electrical connection means is a spring washer interposed between said insulating substrate and said shaft member.

* * * * *